United States Patent [19]

Hult et al.

[11] Patent Number: 4,993,106

[45] **Date of Patent: * Feb. 19, 1991**

[54] PORTABLE HAND HELD VACUUM CLEANER

[75] Inventors: David R. Hult; Mark J. Tomasiak, both of O'Fallbon County, Mo.

[73] Assignee: Emerson Electric Co., St. Louis, Mo.

[ * ] Notice: The portion of the term of this patent subsequent to Feb. 13, 2007 has been disclaimed.

[21] Appl. No.: 454,357

[22] Filed: Dec. 21, 1989

Related U.S. Application Data

[63] Continuation of Ser. No. 229,494, Aug. 8, 1988, Pat. No. 4,920,608.

[51] Int. Cl.[5] ..... A47L 5/24

[52] U.S. Cl. ..... 15/339; 15/344; 15/350; 15/353

[58] Field of Search ..... 15/339, 344, 350, 353

[56] References Cited

U.S. PATENT DOCUMENTS

| | | | |
|---|---|---|---|
| 4,421,964 | 12/1983 | Buchtel | 15/350 X |
| 4,542,557 | 9/1985 | Levine | 15/344 |
| 4,798,613 | 1/1989 | Hetherington | 15/344 X |
| 4,821,366 | 4/1989 | Levine | 15/344 |
| 4,899,418 | 2/1990 | Steiner et al. | 15/344 |
| 4,905,342 | 3/1990 | Ataka | 15/344 |

FOREIGN PATENT DOCUMENTS

| | | | |
|---|---|---|---|
| 170720 | 2/1986 | European Pat. Off. | 15/344 |
| 2137896 | 10/1984 | United Kingdom | 15/344 |

*Primary Examiner*—Chris K. Moore

*Attorney, Agent, or Firm*—Polster, Polster and Lucchesi

[57] ABSTRACT

A portable hand held vacuum cleaner is disclosed as having a housing with a handle to lift and operate the vacuum cleaner, and a nozzle/debris container releasably locked to the housing. The housing contains a motor driven blower that draws air and debris (wet or dry) into the nozzle/debris container for depositing the debris therein, while allowing air to be exhausted through the blower and then through the housing to atmosphere. The blower is constructed with first and second jointly rotatable elements having a series of circumferentially spaced blower exhause passageways and a transversely extending blower passageway adjacent the nozzle/debris container, for increased efficiency. A combined filter and seal is positioned in sealing engagement between the housing and the nozzle/debris container while affording filtering of debris from air between the nozzle/debris container and the blower in the housing. The housing is also capable of accommodating different multiple combinations of batteries with the motor and the size of the blower being increased to accommodate the increase in the number of batteries in the housing. For wet vacuuming, a squeegee with a wiper blade is available. Also, a one-piece push button facilitates operation and releasable locking/unlocking engagement of the housing relative to the nozzle/debris container.

4 Claims, 6 Drawing Sheets

PORTABLE HAND HELD VACUUM CLEANER

This is a continuation of application Ser. No. 229,494, filed on Aug. 8, 1988, now U.S. Pat. No. 4,920,608, issued May 1, 1990.

BACKGROUND OF THE INVENTION

The present invention relates to portable hand held vacuum cleaners, and more particularly, to a portable hand held vacuum cleaner for wet/dry vacuum cleaner applications having an increased efficiency and versatility over prior art designs.

Portable hand held vacuum cleaners have become extremely popular for cleaning a variety of surfaces in homes, offices, cars or wherever there are hard-to-reach places. These portable cordless vacuum cleaner units are relatively light weight and have a handle in order to enable a user to readily utilize them in places where canister, upright or shop type vacuum cleaners cannot be used. As will be appreciated, these portable vacuum cleaners are utilized typically for small clean-up jobs or hard-to-reach places.

Some examples of such cordless, portable vacuum cleaners are shown in U.S. Pat. Nos. 4,011,624; 4,209 875; 4,225,814; 4,536,914; and 4,542,557. In addition, reference is also made to the portable, cordless wet/dry vacuum cleaner shown in copending patent application Ser. No. 077,234 filed July 24, 1987 entitled "Portable Wet/Dry Vacuum Cleaner and Recharging Base", now abandoned.

While such prior art portable hand held vacuum cleaners have worked well for their intended purposes, they have been primarily useful for picking up light weight dry debris, such as dust and small particulate matter. Where heavier and more dense particulate matter is encountered, they have been less effective. In fact, even where dust or other lighter particulate matter are desired to be picked-up or collected, the overall efficiency and effectiveness of the prior cordless vacuum cleaners has been less than desired.

With most of the aforementioned prior art portable vacuum cleaners, they were also not constructed for picking-up or collecting wet debris, such as liquid spills. For example, the filters and motors of some of the prior art portable vacuum cleaners would unnecessarily be exposed and/or not adapted to wet debris.

Typically constructed portable hand held vacuum cleaners include a motor driven blower to forcibly draw air through the vacuum cleaner housing, as well as for exhausting the air from the housing to the atmosphere. As will be understood from the above discussion, prior art portable hand held vacuum cleaners have had limited efficiency, and thus, the ability of such portable hand held units to pick up or collect heavier or more dense debris, or for that matter, even picking up lighter weight debris, has been limited.

Another limiting factor is the efficiency and effectiveness of the air flow path through the portable vacuum cleaner units, while depositing debris in a debris canister or container. Most of the prior art vacuum cleaner units do not have efficient air flow communication within the vacuum cleaner, nor has the debris been selectively deposited in a debris canister or container separate from an air communication channel, while maintaining an efficient air flow path or communication channel throughout the unit.

To separate stray debris from air flowing in the air communication path or channel in the portable vacuum cleaner units, a filter has been placed between the debris container and the blower to separate or prevent debris from entering the blower, which would not only affect the efficiency of the unit, but could damage or impede the operation of the motor and other components, as well. Unfortunately, most filters have limited usefulness, and also have not been used in conjunction with air seals in such a way as to enhance the effectiveness and operation of the portable hand held vacuum units.

In most cases, portable hand held vacuum cleaner units include a rechargeable battery pack incorporated within the vacuum cleaner housing. A battery charger is conventionally provided with such units, for stepping the current down from the 110 volt alternating current at a wall socket to an appropriate voltage with a direct current for operating the unit. The aforementioned prior art designs were not readily capable of accommodating different multiple combinations of batteries therein, in order to provide various price points using the same basic unit design. Further, the portable hand held vacuum cleaners of prior art designs were not easily changed to accommodate different power requirements, where the number of batteries was increased or decreased, for different models at different levels of marketing.

SUMMARY OF THE INVENTION

Among the several objects and advantages of the present invention may be noted:

the provision of a new and improved portable hand held vacuum cleaner which overcomes the aforenoted deficiencies of the prior art;

the provision of the aforementioned portable hand held vacuum cleaner which may be used for both dry and wet debris applications;

the provision of the aforementioned portable hand held vacuum cleaner which has a new and improved blower construction to provide substantial air output and efficiency in the air flow path or channel throughout the vacuum cleaner housing;

the provision of the aforementioned portable hand held vacuum cleaner including a combined filter and seal which is positioned in sealing engagement between a housing and debris container, while enabling the filter to separate debris from air in the air flow path through the vacuum cleaner unit;

the provision of the aforementioned portable hand held vacuum cleaner which is capable of accommodating different multiple combinations of batteries therein, while requiring only the motor and blower size to be increased to accommodate increases in the number of batteries desired to be used in the unit;

the provision of the aforementioned portable hand held vacuum cleaner where the debris container is constructed to direct debris in a rotating or swirling motion away from the filter for accumulation in the debris container;

the provision of the aforementioned portable hand held vacuum cleaner which includes a housing and debris container that are releasably secured and separated relative to one another by a one-piece molded push button, in conjunction with other fastener components;

the provision of the aforementioned portable hand held vacuum cleaner including a squeegee having a squeegee wiper held by a squeegee holder that is capable of being releasably attached to the debris container to allow fluids to be collected on opposite sides of the squeegee wiper for deposit within the debris container; and the provision of the aforementioned portable hand held vacuum cleaner which is powerful, highly efficient, reliable, easy to manipulate, readily convertible between dry media and wet media applications, capable of storing battery charger wires or a squeegee thereon, is of rugged and durable construction, requires minimal changes to use the same basic unit for various prince point versions, is made of a minimum number of parts, and is otherwise well adapted for the purposes intended.

Briefly stated, the portable hand held vacuum cleaner of the present invention includes a housing having a handle permiting a user to lift and operate the vacuum cleaner, and a nozzle/debris container releasably secured to the housing. The housing includes a motor and blower driven by the motor for communication with the nozzle/debris container for forcibly drawing air and debris entrained in the air into the nozzle/debris container to deposit debris within the container and to exhaust air therefrom and then through exhaust openings in the housing to the atmosphere. A circumferential seal and filter is operably associated relative to one another and sealed to the housing and nozzle/debris container The seal circumferentially surrounds the filter and is positioned for sealing engagement between the housing and nozzle/debris container to seal off from the atmosphere the air communication between the blower and the nozzle/debris container. The filter is positioned between the blower and the nozzle/debris container to require air exhausted from the nozzle/debris container to pass through the filter.

The blower is provided with a series of circumferentially spaced blower exhaust passageways which also interiorly communicate with a transversely extending blower passageway adjacent the nozzle/debris container for drawing air through the air communication path in the vacuum cleaner.

The blower is constructed by first and second rotatable elements which may be adjustably moved relative to one another to increase or decrease the size of circumferentially spaced blower exhaust passageways for different vacuum cleaner models.

The seal and filter are preferably a combined seal and filter for joint insertion and removal from the vacuum cleaner. The seal extends circumferentially around the filter and is made from a compressible material such as polyurethane The filter includes a series of closely spaced folded material pleats preferably having a frazier air flow of 90 or more for efficient air communication, while restricting debris flow therethrough.

The nozzle/debris container includes a channel which extend from an air/debris inlet proximate the container bottom to an air/debris outlet within the nozzle/debris container. Deflector means in the form an upper deflector extending from an upper wall of the nozzle/debris container and a lower deflector extending from a bottom wall of the nozzle/debris container are constructed, arranged and configured relative to one another to direct debris in a rotating or swirling motion away from the filter for accumulation within the front end of the nozzle/debris container, filling from the front towards the filter-maximum container/filter utilization.

The housing of the vacuum cleaner is capable of accommodating different multiple combinations of batteries therein, for various price point models of the same basic vacuum cleaner unit, with the motor and the size of the circumferentially spaced blower being increased to accommodate an increase in the number of batteries in the housing.

For releasably locking and unlocking the housing relative to the nozzle/debris container, an integral one-piece push-button lever lock is utilized The lever lock is constructed as an integrally molded unit to provide pivotal movement, resiliency and locking engagement for use between adjacent segments, such as in a housing or nozzle-debris container.

A squeegee for wet debris applications may be releasably mounted within the nozzle of the nozzle/debris container and includes a squeegee wiper mounted within and attached to a squeegee holder, the later being releasably mounted within the aforesaid nozzle. The squeegee holder engages and secures the squeegee wiper thereto while providing fluid communication openings on opposite sides of the squeegee wiper for collecting fluid and debris within the nozzle/debris container.

Other and further objects and advantages of the present invention will become more apparent from the description that follows.

BRIEF DESCRIPTION OF THE DRAWINGS

Corresponding reference numerals will be used throughout the various figures in the drawings.

DESCRIPTION OF THE PREFERRED EMBODIMENT

The portable hand held vacuum cleaner of the present invention is constructed for picking up both wet and dry media or debris. Wet debris includes wet, solid material such as dust, wet mud particles, wet saw dust, and even standing liquids, such as water, that might be spilled on a floor or counter top. In addition, the portable hand held vacuum cleaner of the present invention will pick up dry media or debris including light weight particles and dust, as well as heavier and more dense particles that can be found on floors, carpets and other surfaces.

Figure 1:
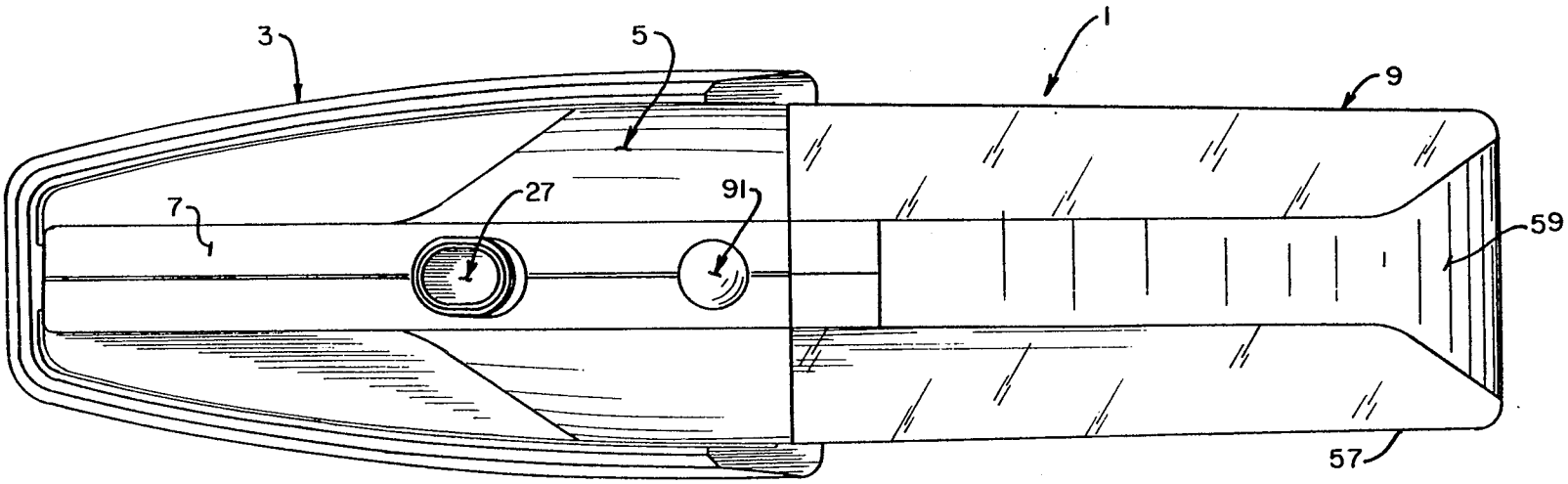
FIG. 1 is a top plan view of the portable hand held vacuum cleaner which is constructed in accordance with the teachings of the present invention.
Figure 2:
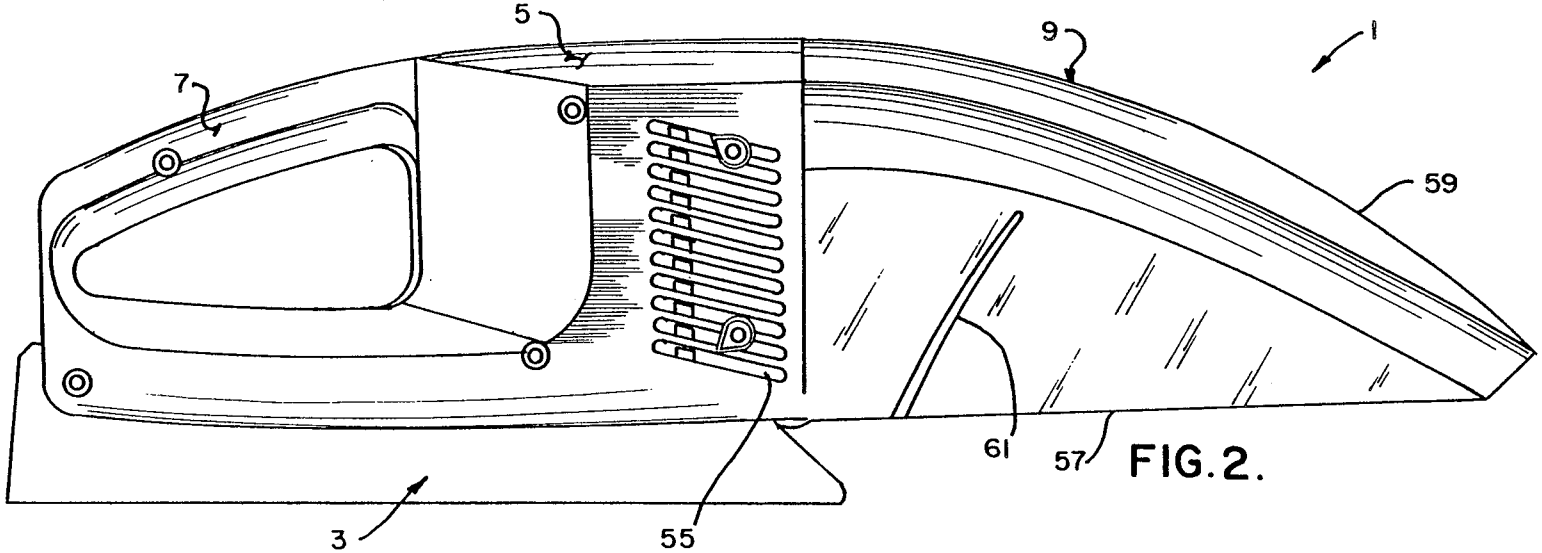
FIG. 2 is a side elevational view of the portable hand held vacuum cleaner and is illustrated as being mounted relative to an associated rechargeable base unit.

As shown in FIGS. 1-2 of the drawings, the portable hand held vacuum cleaner for both wet/dry applications is indicated in its entirety by reference character 1. The vacuum cleaner 1 includes a recharging base and holder, as generally indicated at 3. The vacuum cleaner 1 specifically includes a housing 5 having a handle 7 permiting a user to lift and operate the vacuum cleaner 1 and a nozzle/debris container 9 which is releasably secured to the housing 5, as will be made apparent hereinafter.

Figures 3, 3A:
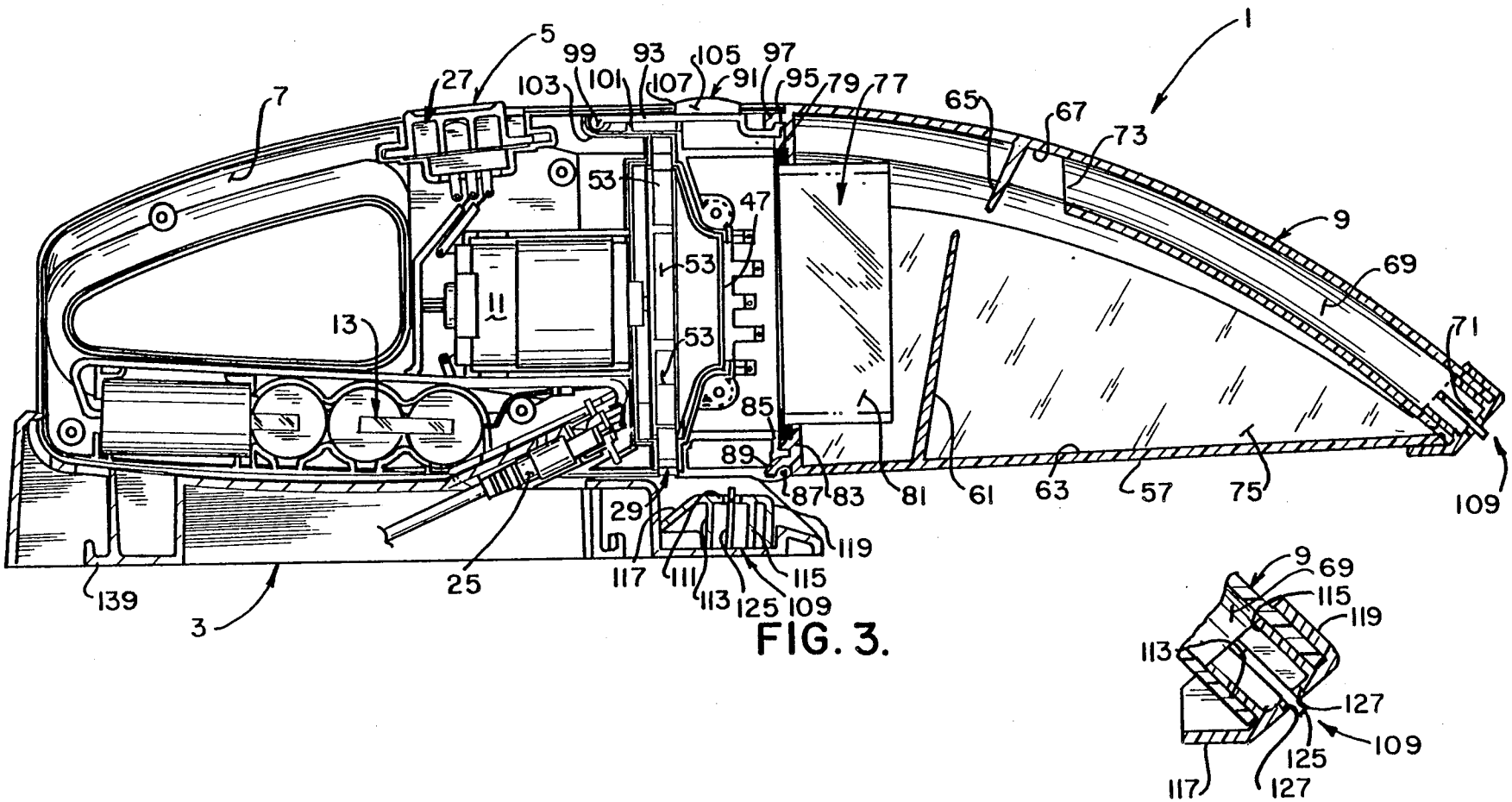
FIG. 3 is a longitudinal cross sectional view of both the vacuum cleaner and rechargeable base unit and illustrating the details of construction of both the vacuum cleaner and the rechargeable base.
FIG. 3A is a fragmentary sectional view of a squeegee mounted in the vacuum cleaner for picking up wet debris.
Figure 5:
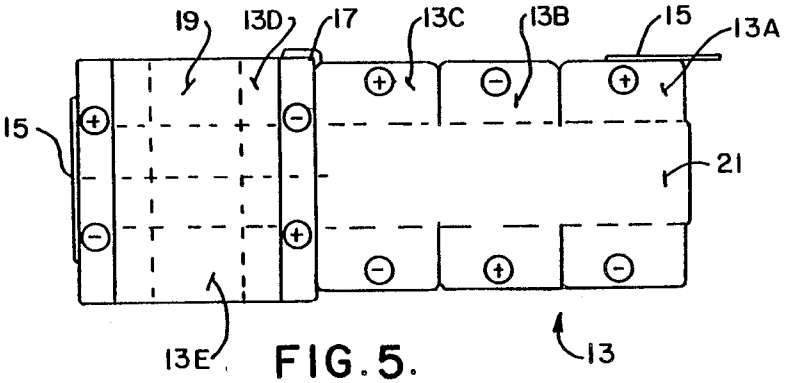
FIG. 5 is a side elevational view of one of the battery pack combinations which may be used in the portable hand held vacuum cleaner of the present invention.
Figure 6:
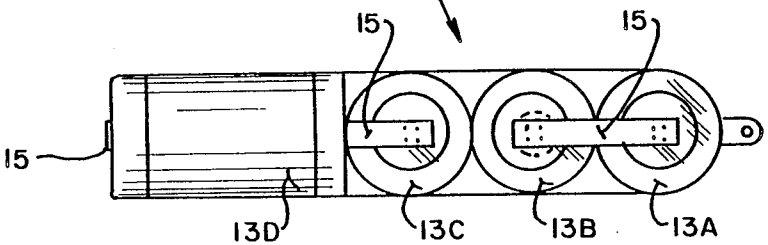
FIG. 6 is a top plan view of the battery pack shown in FIG. 5.

As illustrated in FIG. 3, the housing 5 is preferably of hollow construction and is molded from a suitable synthetic resin material such as polypropylene. Housing 5 has an appropriate DC electric motor 11 mounted therein. Motor 11 is energized by a battery pack 13 which comprises a plurality of suitable rechargeable batteries 13A through 13E, for example, as shown in FIGS. 5 and 6 of the drawings.

The housing 5 is constructed so as to accommodate different multiple combinations of batteries 13A through 13E therein. As shown in FIGS. 3 of the drawings and as illustrated in FIGS. 5-6, the battery pack 13 is shown to include 5 rechargeable batteries 13A through 13E, with three batteries 13A through 13C extending generally transverse to the vacuum cleaner 1, while rechargeable batteries 13D, 13E are generally longitudinally aligned relative to the vacuum cleaner 1. FIGS. 5-6 of the drawings shows the battery pack 13 as having a series of juxtaposed rechargeable batteries 13A through 13E secured to one another by spot welded elongated tabs or strips 15 between adjacent batteries, some of the tabs or strips 15 being bent as at 17 to secure the transversely and longitudinally extending batteries 13C, 13D and 13E relative to one another. As will be appreciated, the tabs or strips 15 electrically connect the positive and negative terminals of adjacent batteries relative to one another in the battery pack 13.

In addition, to preserve and protect the batteries, each of the batteries 13*a*, 13*b* can be individually shrinked wrapped in a protective transparent plastic film. Also, batteries in two and three sets will also be wrapped to form individual battery packs. Thus, an endless plastic tube or tape 19 is wrapped around the two set pair of batteries 13*d*, 13*e* to hold them together, while the endless tube or tape 21 is wrapped around the three batteries 13A-13C to hold them together as unit. As will be described in further detail herein, the vacuum cleaner 1 of the present invention is constructed to permit using battery packs having two batteries, three batteries, four batteries, or five batteries, depending on the model of vacuum cleaner 1 desired.

Figure 4:
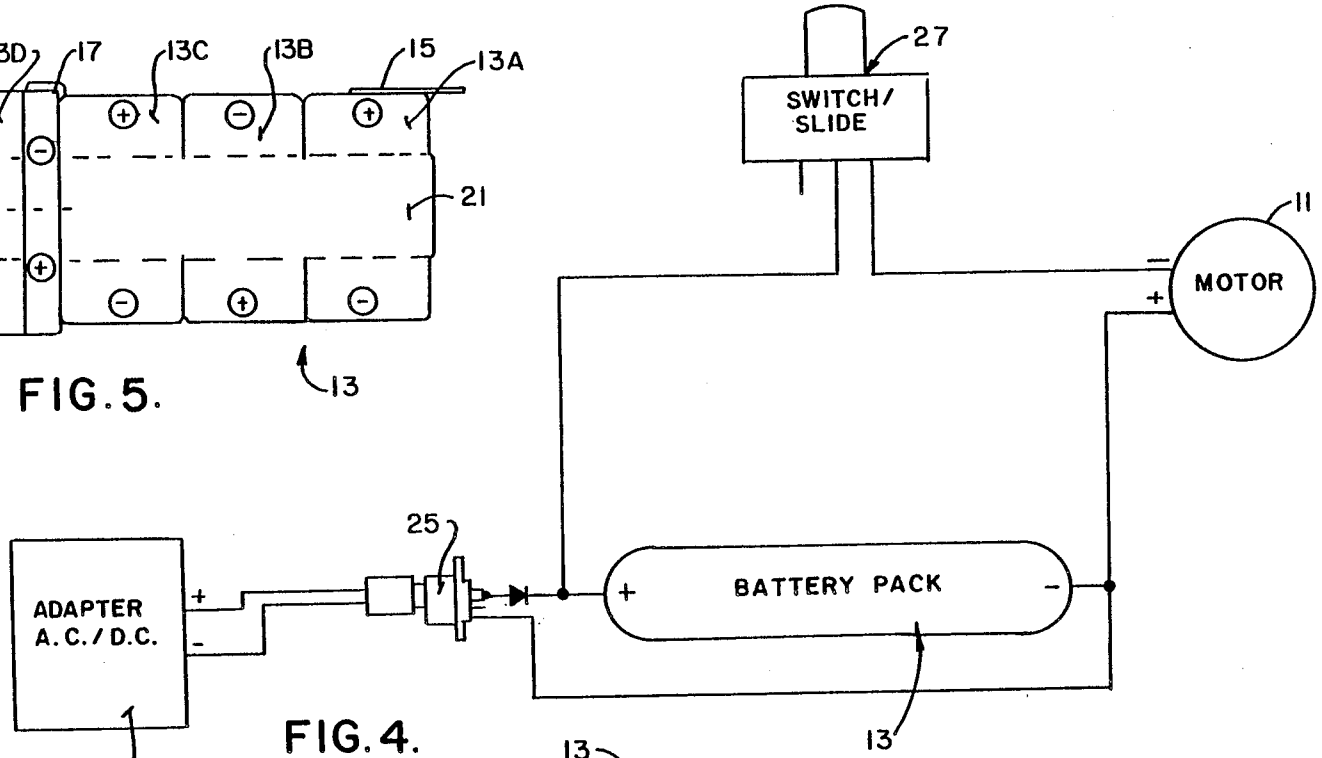
FIG. 4 is a schematic electrical diagram illustrating the operative electrical components used with the vacuum cleaner and rechargeable base unit of the present invention.

As shown in FIG. 4 of the drawings, the battery pack 13 is recharged through a AC/DC adapter 23 which is connected through suitable leads to a plug-in-adapter 25 associated with the rechargeable base unit 3 that keeps the battery pack 13, including the individual batteries therein, charged when the vacuum cleaner 1 is mounted in the recharging base and holder 3. As also illustrated in FIG. 4, the battery pack 13 will energize the motor 11 when the switch slide 27 mounted in the housing 5 is depressed to electrically interconnect the battery pack 13 to the motor 11 for operation thereof, as will understood.

The same basic vacuum cleaner unit 1 illustrated in the drawings may be used with different multiple combination of batteries 13. The battery pack 13 illustrated in FIGS. 3 and 5-6 of the drawings show 5 batteries 13A-13E mounted in the housings, with three batteries 13*a* through 13*c* extending generally transverse to the vacuum cleaner housing 5, while two batteries, 13D, 13E extend longitudinally thereto. Where it is desired to use only four batteries, the three battery set 13A-13C would be replaced by a two battery set 13D, 13E to provide two sets of two batteries 13D, 13E mounted transversely and longitudinally relative to the vacuum cleaner 1. Where only three batteries are desired, the two battery combination 13D, 13E would not be used in the housing 5, leaving only the three batteries 13A-13C extending transverse to the vacuum cleaner 1. Finally, if only two batteries are desired, two batteries 13D, 13E would be mounted in the housing 5, extending generally longitudinally of the vacuum cleaner 1, as will be apparent.

Increasing the number of batteries requires an increase in the motor Il and the blower 29 in the vacuum cleaner 1, while all other components remain the same. In addition, the adapter 23 and adapter jack 25, used with the recharging base unit 3, will also have to be changed as the battery power increases or decreases, as desired. It will be readily understood that the motor 11 of the vacuum cleaner 1 and the adapter 23 and adapter jack 25, used with the recharging base 3, may be easily changed to accommodate different multiple battery combinations. This greatly simplifies the manufacturing process in producing different models, such as various price point models, for various desired marketing levels.

In addition, in accordance with the present invention, the blower construction may be changed to also accommodate different power requirements from different multiple battery combinations in the vacuum cleaner 1. As shown in FIGS. 3 and 7-9 of the drawings, the blower or blower wheel 29 is driven by the DC motor 11 via the shaft 31 in a typical manner. The blower or blower wheel 29 is constructed from a first rotatable element or spirally vaned wheel 33 and a second rotatable element or cover plate 35, which are joined to one another for joint rotation by the motor 11.

Figure 9:
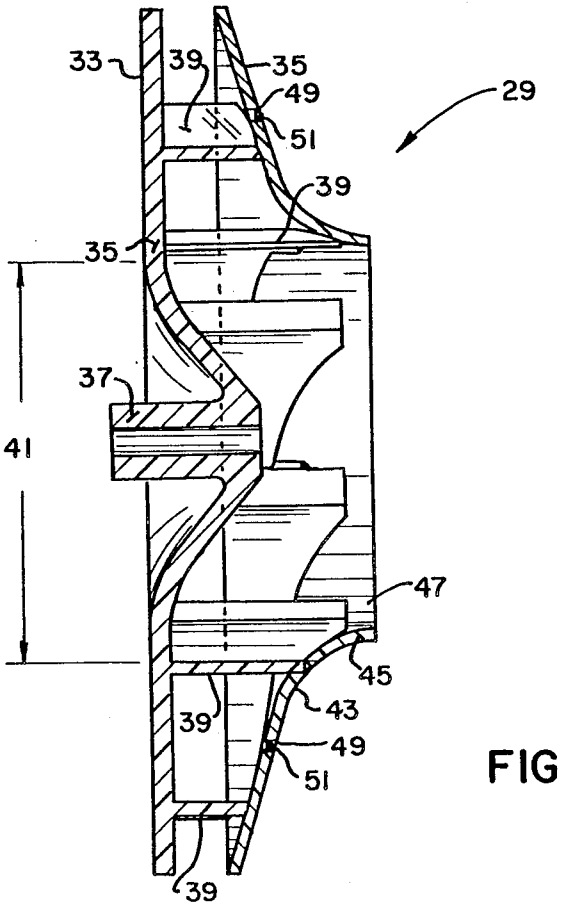
FIG. 9 is an enlarged sectional view of the first and second jointly rotatable elements forming the blower construction used in the vacuum cleaner of the present invention.
Figure 8:
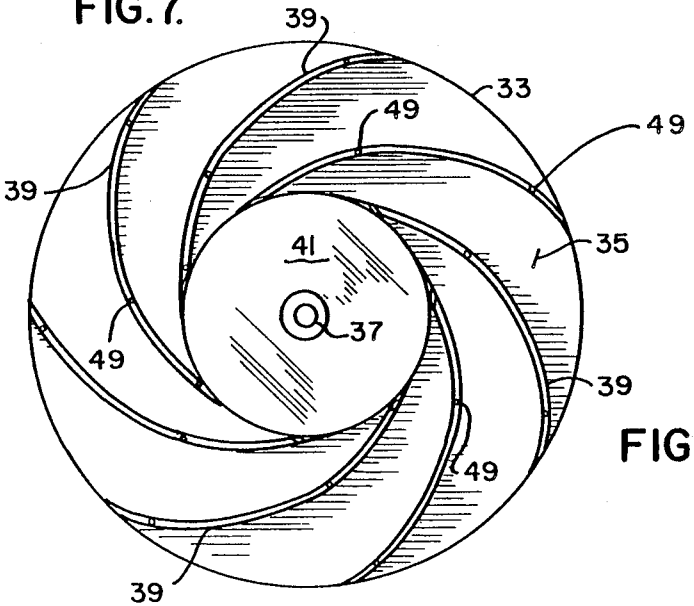
FIG. 8 is an enlarged top plan view of one of the rotatable elements forming the blower and illustrating spiral vanes formed on one face thereof.

The spirally vaned wheel 33 is a one-piece integrally molded plastic element having a disk shaped face or plate 35 with centrally positioned integral shaft support 37 for receiving the shaft 31 of the motor 11. Extending from one face of the disk-shaped face 35 are a plurality of spaced spirally extending vanes 39. Each of the spiral vanes 39 extend from an inner margin which is outside of the flat centrally positioned base section 41 and spirally extend outwardly therefrom to an outer margin which coincides with the outer margin of the disk shaped base 35, as best seen in FIG. 8 of the drawings The spirally extending vanes 39 also taper as they spirally extend from their inner to their outer margin, as shown in FIG. 9 of the drawings. This allows the complementary shaped cover plate 35 to be juxtaposed to and assembled to the spiral vaned wheel 33.

The cover or plate 35 is an integral one-piece plastic element having an outer sloping or tapering wall 43, conforming to the outward tapering of the spiral vane 39, to form a generally circumferential frusto-conical section. The frusto-conical section 43 formed by the tapering or sloping wall thereof, is integrally interconnected to a circumferentially extending, curvilinear section 45, also conforming, in part, to the tapering or sloping spiral vanes 39, and providing a generally transversely extending bore or opening 47 having a diametrical extent which generally conforms to the flat or central base section 41 of the spirally vaned wheel 33, as seen in FIG. 9 of the drawings. For assembling the spirally vaned wheel 33 to the cover or plate 29, it will be noted that the vanes 39 have a series spaced studs 49 along the top surface thereof for complementary engagement with mating openings 51 in the cover or plate 29. Suitable adhesive may be employed between the upper surface of the vanes 39 and the lower surface of the cover or plate 29 for also bonding the elements together for joint rotation thereof by the motor 11.

Figure 7:
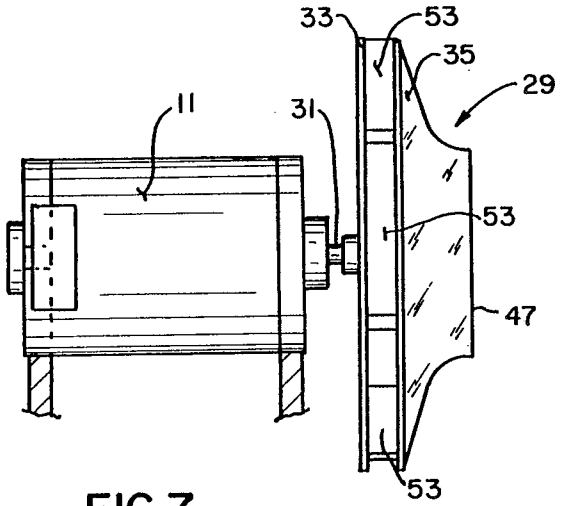
FIG. 7 is a fragmentary side elevational view of the motor and blower which is used to develop an air communication or air flow path through the vacuum cleaner.

The above described construction of the blower or blower wheel 29 not only provides increased efficiency in the portable hand held vacuum cleaner 1, but also enables the blower or blower wheel 29 to be readily changed to accommodate different multiple battery combinations used in the vacuum cleaner. Specifically, when the blower or blower wheel 29 is assembled as shown in FIGS. 3 and 7 of the drawings, a series of circumferentially spaced blower exhaust passageways 53 will be provided for forcibly drawing air and establish an air flow path through the vacuum cleaner 1. The circumferentially extending blower exhaust passageways 53 are each formed by adjacent spiral vanes 39 of the shaped base 33 and the corresponding overlying areas of the cover plate 29. The blower or blower wheel 29 is thus constructed to draw air through the transversely extending passageway 47 along the spirally extending passageways between the base 33 and cover plate 29, to open up into the circumferentially spaced blower exhaust passageways 53, for drawing air through the vacuum cleaner 1, as will be further understood from the description that follows.

Where the battery power is increased for a specific vacuum cleaner models, the size of the circumferentially spaced blower exhaust openings 53 may also be increased to accommodate the battery power increase in the housing 5 In general, the greater number of batteries used requires larger circumferentially spaced blower exhaust openings 53, and vice versa. This may be easily achieved by molding the spirally vaned wheel 33 with spiral vanes 39 of greater height, so as to provide larger circumferentially spaced blower exhaust openings 53. Thus, by simply changing the molds of the spirally vaned wheel 33, so as to produce spiral vanes 39 of different height, the blower or blower wheel 29 may be changed to accommodate increases or decreases of battery power in the vacuum cleaner 1. This is important in providing the desired efficiency in forcibly drawing air through an air flow path in the vacuum cleaner 1, as will be described.

Figure 16:
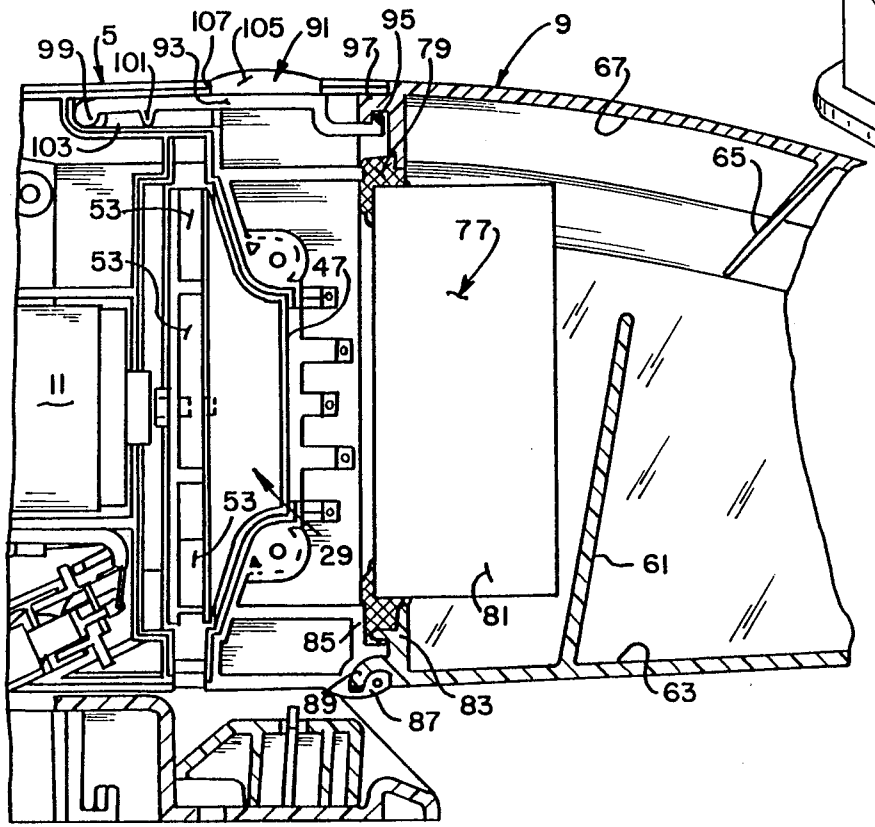
FIG. 16 is a fragmentary longitudinal cross sectional view illustrating the construction of a one-piece integrally molded push button lever lock and the arrangement of the blower relative to the combined filter and seal in the vacuum cleaner of the present invention.

As shown in FIGS. 3 and 16 of the drawings, the motor driven blower or blower wheel 29 is located on the outer or forward end of the housing 5 with the transversely extending blower passageway 47 of the blower or blower wheel 29 positioned adjacent the nozzle/debris container 9, so as to establish a flow path between the interior of the nozzle/debris container 9 and the blower 29, such that the blower may forcibly draw air from within the nozzle/debris container 9 and exhaust air through the housing 5 by means of a number of air outlet openings 55 (see FIG. 2) provided in both sides of the housing 5.

According to the present invention, the air forcibly drawn by the blower 29 through the vacuum cleaner 1 and debris entrained in the air will pass through the nozzle/debris container 9 that is constructed to collect debris within the nozzle/debris container 9, while exhausting air through the blower wheel 29 and through the exhaust opening 55 in the housing 5 to atmosphere.

The nozzle/debris container 9 includes a lower drum or container section 57 and a drum cover 59 which are bonded and joined to one another to form a one-piece nozzle/debris container 9. A lower drum or container section 57 is molded from a suitable synthetic resin, such as a polycarbonate with suitable transparencies so that a user may readily visually observe the amount of debris collected by the vacuum cleaner within the nozzle/debris container 9. The upper drum cover 59 is also preferably made from a suitable plastic resin material such as a polycarbonate, but in this case is preferably non-transparent to provide a pleasing design or aethestic appearance to the overall design of the vacuum cleaner 1.

Functionally, the nozzle/debris container 9, with the lower and upper drum or container section 57, 59 bonded together, provides a lower deflector 61 which extends angularly upwardly from the bottom wall 63, as best seen in FIGS. 2-3 of the drawings. An upper deflector 65 depends from an upper wall 67 and is also angularly offset at a different angular inclination than the lower deflector 61, as seen in FIG. 3. Included within the nozzle/debris container 9 is an enclosed channel 69 which extends from an air/debris inlet 71 proximate the bottom of the nozzle/debris container 9 to an air/debris outlet 73 within the nozzle/debris container 9.

When the air/debris inlet 71 of the air/debris container 9 is positioned to pick up debris, air flowing through the enclose channel 69 will pull both air and debris entrained in the air up along the enclosed channel 69 and past the air/debris outlet 73 until it encounters the upper deflector 65. At this point, the air will expand and loose velocity while the debris and air are both deflected from the upper deflector 65 to the lower deflector 61 in a rotating and swirling motion towards the front of the chamber 75 for accumulation of the debris therein. While the debris is collected within the chamber 75 of the nozzle/debris container 9, air will flow in the air flow path between the upper and lower deflectors 61, 65 respectively and will then be directed through the combined filter and seal 77 for evacuation and exhaust through the blower wheel 29 and then through the exhaust openings 55 in the housing 5, as described above.

Figure 10:
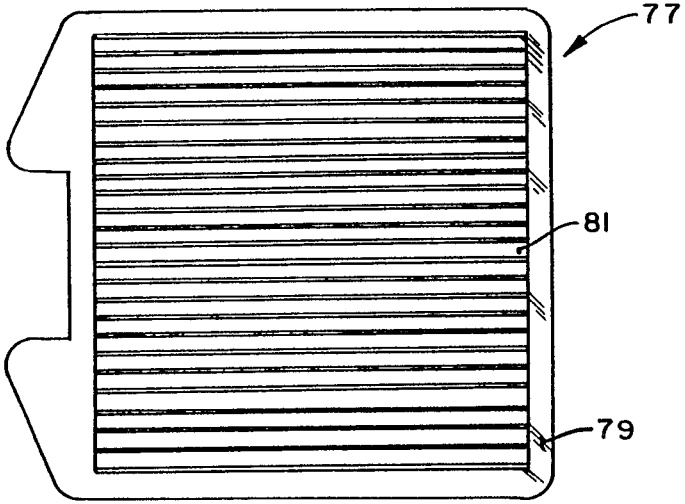
FIG. 10 is a top plan view of the combined filter and seal which is used in the present invention.
Figure 15:
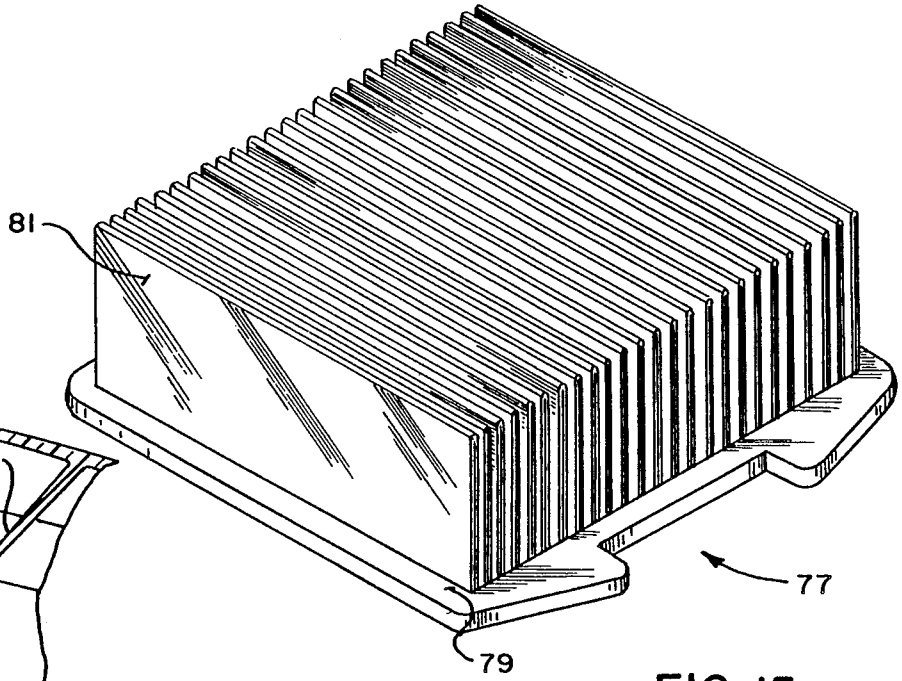
FIG. 15 is an enlarged perspective view of the combined filter and seal.

The combined filter and seal 77 is constructed to provide sealing engagement between the housing 5 and nozzles/debris container 9, while restricting the flow of debris through the filter thereof. As best seen in FIGS. 10 and 15 of the drawings the combined filter and seal includes a circumferential seal section 79 preferably formed from a compressible material such as polyurethane and a filter having a series of closely spaced, folded material pleats 81. The inner margin of the circumferential seal 79 is adhesively bonded or secured to the outermost periphery of the series of closely spaced, folded material pleats 81 so as to secure them relative to one another and provide a combined filter and seal construction. It is important that the filter material, from which the folded material pleats 81 is made, restricts the flow of debris, without restricting air flow, which would interfere with the efficiency of the vacuum cleaner 1. Toward this end, it has been discovered that a filter material with a frazier air flow of 90 or more will best achieve the intended results limiting debris flow, while allowing relatively free air flow through a series of closely spaced, folded material pleats 81.

As shown best in FIG. 16 of the drawings, the combined filter and seal 77 is positioned between the blower 29 and the nozzle/debris container 9 so as to require air exhausted from the nozzle/debris container 9 to pass through the series of closely spaced, folded material pleats 81 to limit debris flow, while permitting substantially unrestricted flow of air therethrough. Also, FIG. 16 illustrates the manner in which the circumferential seal is positioned and resiliently compressed by corresponding portions of the housing 5 and nozzle/debris container 9 to provide sealing engagement of the housing 5 and nozzle/debris container 9 relative to one another for increased efficiency and operation of the vacuum cleaner 1. Specifically, a nozzle/debris container 9 has a seal and filter support 83 comprising longitudinally and transversely extending shoulders for engaging the circumferential seal 77, and the housing 5 includes a transversely extending contacting surface 85 which engages the compressible circumferential seal 79 on the opposite side thereof so as to resiliently compress the circumferential seal and provide sealing engagement between the housing 5 and nozzle/debris container 9. The housing 5 and nozzle/debris container 9 are releasably secured to one another in order to provide the aforementioned sealing engagement with a circumferential seal 79 of the combined filter and seal 77, as well as permit releasable disengagement from one another so as to permit debris accumulated in the chamber 75 of the nozzle/debris container 9 to be removed. When the housing 5 and nozzle/debris container are releasably disengaged from one another, as will shortly be described, the combined filter and seal 77 can also then be disassociated from the nozzle/debris container 9 so to permit debris from the chamber 75 of the nozzle/debris container 9 to be emptied. At this time, the combined filter and seal 77 may also be shaken by hand to remove any debris or other particles that may be attached to the closely spaced, folded material pleats 81. Replacing the combined filter and seal 77 within the nozzle/debris container 9 and releasably re-attaching the housing 5 and the nozzle/debris container 9 to one another readies the vacuum cleaner 1 for continued operation.

For releasably securing the housing 5 and nozzle/debris container 9 relative to one another, snap-fitting and pivoting complementary fastening sections 87, 89 are provided on the nozzle/debris container 9 and housing 5, respectively, along the lower bottom thereof. This permits pivotal separating moving of the nozzle/debris container 9 from the housing 5, for removing the combined filter and seal 77, and for evacuating the chamber 75 of the nozzle/debris container 9. A one-piece push button lever lock 91 is mounted relative to the housing 5 and has integral components for releasably securing the nozzle/debris container 9 relative to the housing 5. Specifically, the one-piece push-button lever lock 91 comprises an integrally molded plastic element, preferably formed from polypropylene, having an elongated body 93 with opposite free ends. One of the ends has a hook shoulder 95 for complementary inter-engagement with a locking shoulder 97 integrally formed on the nozzle/debris container 9, while the other end of the elongated body 93 has a ball portion 99 and depending finger !01 adjacent to the ball portion 99 but spaced therefrom, as illustrated in FIGS. 3 and 16 of the drawings. The housing 5 has an integral upper channel 103 having a closed end that is complementary configured relative to the ball portion 99 of the push-button lever lock 91 so as to allow cooperative pivotal movement of the ball portion 99 therewithin. The integral depending finger portion 101 of the push-button lever lock 91 engages the bottom surface of the integral channel 103 so as to resiliently bias the push-button 105 through a complementary opening in the upper wall of the housing 5. The one-piece push-button lever lock 91 is thus normally biased with the push button 105 projecting through the opening 107 in the housing 5 as the result of the depending finger 101 engaging the bottom wall of the closed channel 103 in the housing 5. When the push button 105 is depressed, ball portion 99 will pivot about the complementary shaped close end of the channel 103 or the elongated body 93 will deflect about the depending finger 101, depending on the construction employed, and allow the push button 105 to be depressed within the opening 107 to the extent necessary to release the hook shoulder 95 thereof from the complementary locking shoulder 97 of the nozzle/debris container 9. This allows separation of the housing 5 and nozzle/debris container 9 from one another. For re-assembly, the nozzle/debris container 9 is simply moved relative to the housing 5 to allow the locking shoulder 97 to cam over the outer face of the hook shoulder 95 for resilient and releasable locking engagement therewith.

Figure 11:
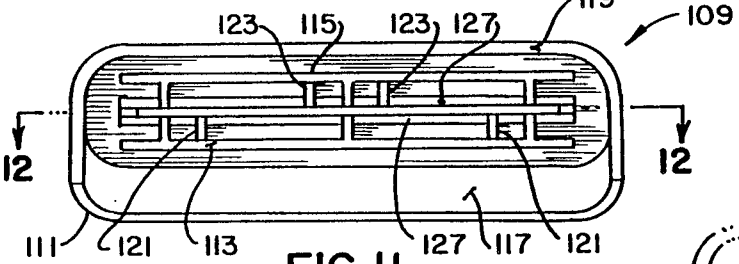
FIG. 11 is a bottom plan view of the squeegee holder and squeegee wiper blade forming the squeegee used for wet media applications in the vacuum cleaner of the present invention.
Figure 12:
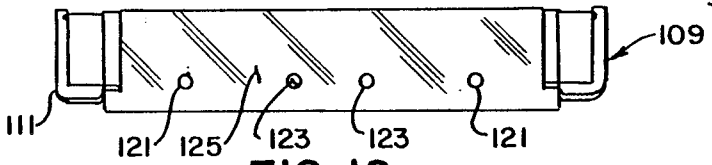
FIG. 12 is a side elevational view as viewed along line 12—12 of FIG. 11.

As heretofore noted, the vacuum cleaner 1 of the present invention is intended for picking up both wet and dry debris. The pick up or collection of dry debris has been previously discussed. With respect to the pick up or collection of wet debris, squeegee 109 shown in FIGS. 3 and 11-12 may be used to enhance the pick-up capabilities of wet debris by the vacuum cleaner 1. Squeegee 109 may be releasably retained within a complementary configured area of the recharging base 3, as shown in FIG. 3 of the drawings The squeegee 109 includes a squeegee holder 111 having a pair of generally parallel integral walls 113, 115 which constructed to provide an interference fit within the channel 69 at the air/debris inlet 71 of the nozzle/debris container 9 (See FIG. 3A). With the walls 113, 115 of the squeegee holder 109 mounted within the channel 69 at the air/debris inlet 71 of a nozzle/debris container 9, the integral or tapering wall 117 will be positioned below the bottom of the nozzle/debris container 9 while the spaced integral wall 119 will extend along an upper portion of the nozzle/debris container 9. all as illustrated in FIG. 3*a* of the drawings Each of the generally parallel interference wall portions 113, 115 have spaced studs 121, 123, respectively, on opposite sides of a center line of the squeegee holder 109 for engaging and securing a squeegee wiper 125 thereto, as best shown in FIGS. 11–12 of the drawings. The squeegee wiper 125 is secured by the spaced studs 121, 123 of the opposed parallel walls 113, 115, while leaving fluid communication openings 127, 127 on opposite sides of the squeegee wiper 125 to enable fluid (air and wet debris) to be collected within the air/debris inlet 71 for movement up into the closed channel 69 of the nozzel/debris container 9. The squeegee wiper 125 may be moved into scraping engagement with a surface to be cleaned, allowing liquid standing on the surface to be cleaned and scraped along with the squeegee wiper 125 collected through the fluid communication openings 127, 127 on opposite sides thereof, for entry into the closed channel 69 of the nozzle/debris container 9.

Figure 13:
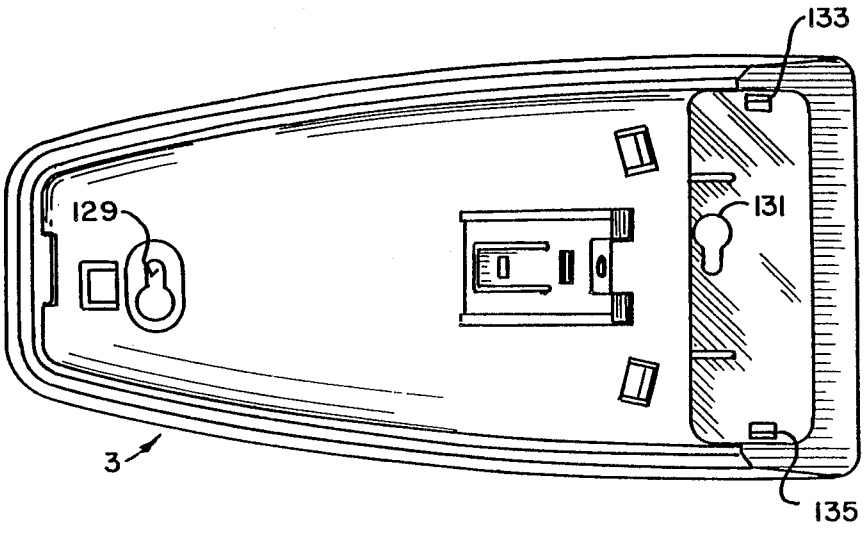
FIG. 13 is a top plan view illustrating the construction of the rechargeable base unit for the vacuum cleaner of the present invention.
Figure 14:
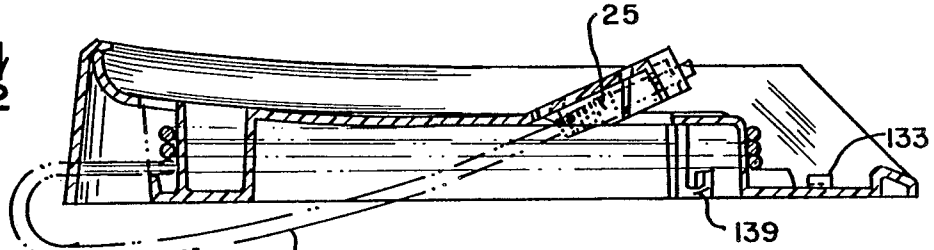
FIG. 14 is a side elevational view, primarily in vertical section, illustrating the construction of the rechargeable base unit for use with the vacuum cleaner of the present invention.

The recharging base 3, as shown in FIG. 13, 14, includes upper and lower keyholes 129, 131 for mounting the recharging base 3 to a wall, as is known. At the lower end of the recharging base 3 are a pair of spaced resilient prongs 133, 135 for resiliently engaging the squeegee holder 109 to releasably retain the same relative to the recharging base 3, as will be understood. As shown in FIG. 14 of the drawings, the adapter plug 25 extends at an angle relative to the recharging base 3 for entry into a complementary shaped adapter receptacle within the housing 5 of the vacuum cleaner 1. A cord 137 of the adapter 25 may be wrapped around an annularly extending wire retaining element 139 integrally molded in the bottom of the recharging base 3, as will be understood. The adapter itself (not shown) will be plugged into a suitable wall receptacle adjacent the area where the recharging base 3 is mounted.

From the foregoing, it will now be appreciated that the portable hand held vacuum cleaner 1 of the present invention may be utilized for both wet and dry debris, with increased efficiency and versatility that has not been possible with prior art units. The new and improved blower wheel forcibly draws air through the vacuum cleaner at greater output and efficiency then other prior art units. At the same time, the combined filter and seal positioned between the blower and the nozzle/debris container provides sealing engagement between the housing and nozzle/debris container, while restricting the flow of debris through the filter, as described above. The configuration and arrangement of the closed channel and upper and lower deflectors of the nozzle/debris container also deflect air and debris entrained in the air in a rotating or swirling motion within the chamber of the nozzle/debris container, while allowing air to be exhausted through the combined filter and seal, and then through the circumferentially spaced exhaust passageways of the blower for evacuation through the housing openings to atmosphere. For both wet and dry applications, the filter/-seal system between the nozzle/debris container and housing, prevents dry or wet debris from entering or damaging a blower, with the combined filter and seal also restricting the flow of dry or wet debris. The one-piece push-button lever lock associated with the housing releasably secures the housing and nozzle/debris container to one another, while facilitating easy separation therefrom. Finally, the simply constructed squeegee wiper and squeegee holder provides quick and easy conversion of the unit from dry to wet applications, while enhancing the pick-up or collection capabilities of wet debris in the vacuum cleaner.

In view of the above, it will be seen that the other objects of this invention are achieved in other advantageous results are obtained.

As various changes could be made in the above construction without departing from the scope of the invention, it is intended that all matter contained in the above description or shown in the accompanying drawings shall be interpreted as illustrative and not in a limiting sense.

We claim:

1. A portable hand held vacuum cleaner comprising a housing having a handle permitting a user to lift and operate said vacuum cleaner and a nozzle/debris container releasably secured to said housing, said housing having a motor and a blower driven by said motor which is in communication with said nozzle/debris container for forcibly drawing air and debris entrained in the air into the nozzle/debris container, a debris filter extending partially within and substantially across the nozzle/debris container to retain debris in the nozzle/debris container while also allowing air to be exhausted from the nozzle/debris container through exhaust openings in said housing to atmosphere, and said nozzle/debris container being transparent along a substantial portion thereof in order that a user may readily visually observe the debris filter including the amount of debris in the nozzle/debris container piled up against the debris filter for determining the efficiency of operation of said vacuum cleaner.

2. The portable hand held vacuum cleaner as defined in claim 1, wherein said debris filter comprises a combined outer circumferential compressible seal and inner filter attached to one another for joint insertion and removal relative to said housing and nozzle/debris container, said outer circumferential compressible seal being in compressible sealing engagement between complementary interfitting circumferential portions of the housing and nozzle/debris container when releasably secured together, while the inner filter extends partially within and substantially across the nozzle/debris container.

3. The portable hand held vacuum cleaner as defined in claim 1, wherein the nozzle/debris container includes deflector means for deflecting debris away from direct flow movement to the inner filter, said deflector means including a deflector attached to a bottom wall within said nozzle/debris container and being positioned in front of and extending upwardly a substantial distance across the inner filter.

4. The portable hand held vacuum cleaner as defined in claim 3 wherein the nozzle/debris container defines a channel including an air/debris inlet and an air/debris outlet, and said deflector extends upwardly from the bottom wall of said nozzle/debris container and is positioned below the air/debris outlet of said channel.

* * * * *